US006471845B1

(12) United States Patent
Dukovic et al.

(10) Patent No.: US 6,471,845 B1
(45) Date of Patent: Oct. 29, 2002

(54) METHOD OF CONTROLLING CHEMICAL BATH COMPOSITION IN A MANUFACTURING ENVIRONMENT

(75) Inventors: John O. Dukovic, Pleasantville, NY (US); William E. Corbin, Jr., Newburgh, NY (US); Erick G. Walton, Underhill, VT (US); Peter S. Locke, Hopewell Junction, NY (US); Panayotis C. Andricacos, Croton-on-Hudson, NY (US); James E. Fluegel, Rhinebeck, NY (US); Evan Patton, Portland, OR (US); Jonathan Reid, Sherwood, OR (US)

(73) Assignees: International Business Machines Corporation, Armonk, NY (US); Novellus Systems, Inc., San Jose, CA (US)

( * ) Notice: Subject to any disclaimer, the term of this patent is extended or adjusted under 35 U.S.C. 154(b) by 0 days.

(21) Appl. No.: 09/461,849

(22) Filed: Dec. 15, 1999

Related U.S. Application Data

(60) Provisional application No. 60/112,375, filed on Dec. 15, 1998.

(51) Int. Cl.[7] ..... C25D 21/12; C25D 5/00

(52) U.S. Cl. ..... 205/81; 205/101; 137/93

(58) Field of Search ..... 205/81, 82, 84, 205/101; 204/228.1–229.7; 118/689, 665; 137/93

(56) References Cited

U.S. PATENT DOCUMENTS

| | | | | |
|---|---|---|---|---|
| 4,068,677 A | * | 1/1978 | De Staur et al. | 137/93 |
| 5,192,403 A | | 3/1993 | Chang et al. | |
| 5,196,096 A | | 3/1993 | Chang et al. | |
| 5,312,532 A | | 5/1994 | Andricacos et al. | |
| 5,352,350 A | | 10/1994 | Andricacos et al. | |
| 5,368,715 A | * | 11/1994 | Hurley et al. | 205/82 |
| 5,385,661 A | | 1/1995 | Andricacos et al. | |
| 5,631,845 A | | 5/1997 | Filev et al. | |
| 5,858,196 A | * | 1/1999 | Ikenaga | 205/82 |
| 6,113,769 A | * | 9/2000 | Uzoh et al. | 205/101 |

* cited by examiner

*Primary Examiner*—Nam Nguyen
*Assistant Examiner*—Wesley A. Nicolas
(74) *Attorney, Agent, or Firm*—Howard J. Walter, Jr.

(57) ABSTRACT

A method for controlling the composition of a chemical bath in which predictive dosing is used to account for changes in the composition of the bath in which the operating characteristics of the process are partitioned into a plurality of operating modes and the consumption or generation of materials related to the process are determined empirically and additions of material are made as appropriate.

11 Claims, 1 Drawing Sheet

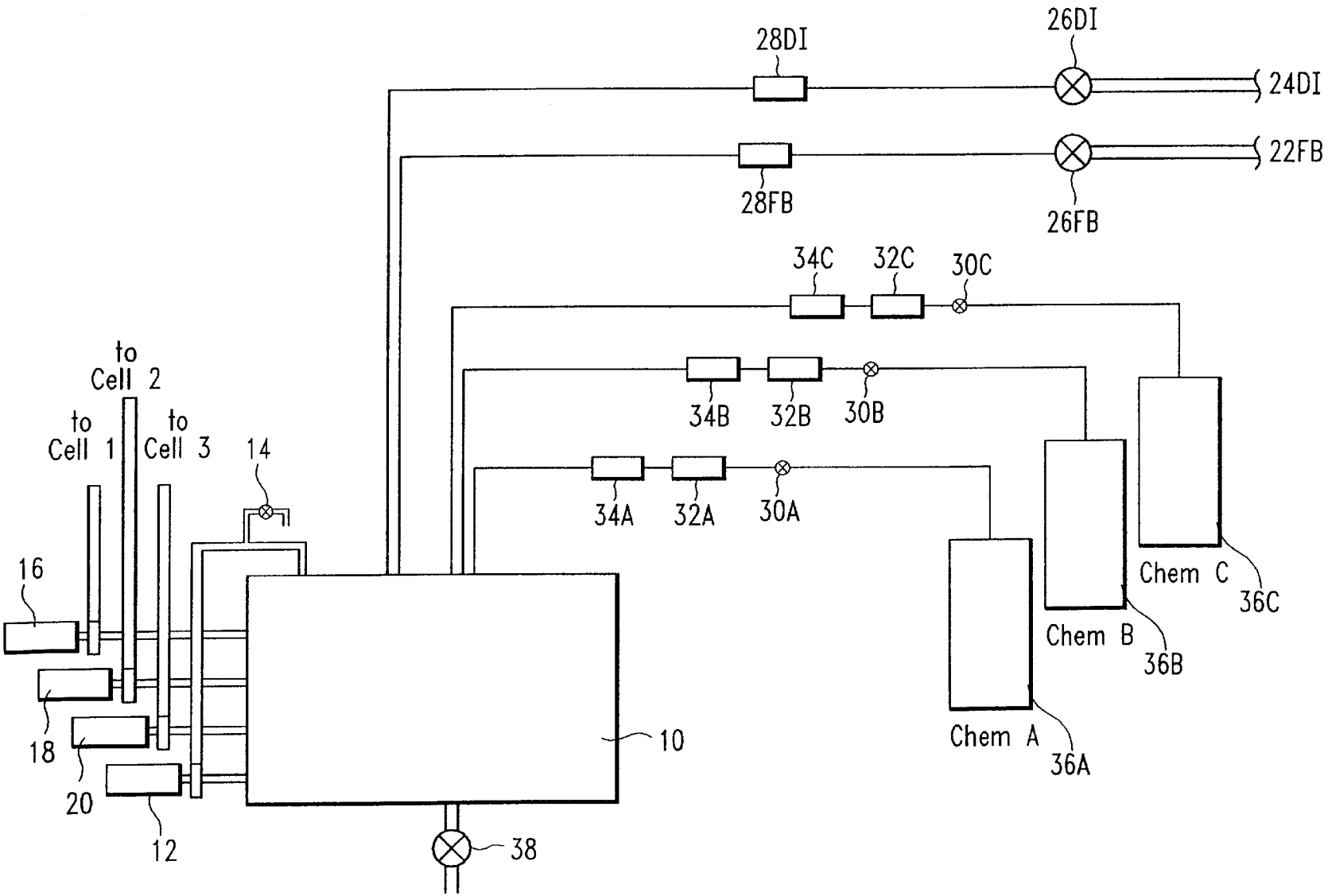
24DI
22FB
26DI
26FB
28DI
28FB
30C
32C
34C
30B
32B
34B
30A
32A
34A
Chem C
36C
Chem B
36B
Chem A
36A
10
38
14
to Cell 3
to Cell 2
to Cell 1
12
20
18
16

METHOD OF CONTROLLING CHEMICAL BATH COMPOSITION IN A MANUFACTURING ENVIRONMENT

This application claims benefit to provisional Application No. 60/112,375, filled Dec. 15, 1998.

BACKGROUND OF THE INVENTION

1. Field of the Invention

This invention relates generally to the field of wet chemical processing and more specifically to methods for controlling the composition of baths used in chemical processing, especially those baths used in plating processes. Specifically, the invention relates to semiconductor processing methods and apparatus for accurately controlling the concentration of chemical constituents which vary over time due to any of several causes.

2. Description of the Prior Art

In the field of chemical processing it is important that the composition and concentration of various constituents be controllable. The use of chemical wet processing has been used in semiconductor manufacturing since its inception in the early 1950s. Control of chemical composition has not been considered a problem in applications such as rinsing and cleaning as the implemented chemical processes were not based on a critical material balance. In such instances, excess volume of reagents or other constituents was a common practice, as little reliance was placed on, or was needed on, the accurate control of reactions or reaction rates.

More recently, there has been an increasing interest in providing accurate control over the composition of any number of chemical processing parameters. Perhaps the most critical area of increased interest has been in that of chemical plating, particularly that of electroplating.

The following patents relate to the controlling of chemical constituents in various applications including electroplating bath composition stabilization. Each patent is hereby incorporated in its entirety for its respective teaching and disclosure.

U.S. Pat. No. 5,192,403 entitled "CYCLIC VOLTAMMETRIC METHOD FOR THE MEASUREMENT OF CONCENTRATIONS OF SUBCOMPONENTS OF PLATING SOLUTION ADDITIVE MIXTURES" and U.S. Pat. No. 5,196,096 entitled "METHOD FOR ANALYZING THE ADDITION AGENTS IN SOLUTIONS FOR ELECTROPLATING OF PbSn ALLOYS" issued to Chang et al., relate to concentration measurement techniques which are useful in evaluating the effects of additions of various components in electroplating bath solutions.

U.S. Pat. No. 5,312,532 entitled "MULTI-COMPARTMENT ELECTROPLATING SYSTEM" issued to Andricacos et al. describes an electroplating system in which semiconductor wafers may be plated with copper.

U.S. Pat. No. 5,352,350, entitled "METHOD FOR CONTROLLING CHEMICAL SPECIES CONCENTRATION," to Andricacos et al., describes a method of controlling the concentration of chemical species in a wet chemical bath by calculating the change in concentration of species based on known changes based on process-active species, non-process-active, deliberate, non-deliberate and time-active changes. Each species was modeled based on several factors, including, but not limited to, material balance, addition of feed stock, as well as time dependent changes such as evaporation or other deleterious events. This patent is relied herein on for the more general aspects of predictive dosing.

U.S. Pat. No. 5,385,661, entitled "ACID ELECTROLYTE SOLUTION AND PROCESS FOR THE ELECTRODEPOSTION OF COPPER-RICH ALLOYS EXPLOITING THE PHENOMENON OF UNDERPOTENTIAL DEPOSITION," to Andricacos et al., describes a plating bath comprising a number of additives which require control during plating.

U.S. Pat. No. 5,631,845, entitled "METHOD AND SYSTEM FOR CONTROLLING PHOSPHATE BATH CONSTITUENTS," TO Filev et al., relates to methods of controlling composition of a chemical system by using feedback from a measured quantity of a constituent to control the flow rate of the constituent.

SUMMARY OF THE INVENTION

To practice electroplated copper-interconnect technology, the copper must be electroplated under precisely controlled conditions. The key to manufacturing control, high yield, and manageable cost of a chemical reaction-based process is control of the composition of the reaction bath, especially the concentrations of certain organic and/or inorganic additives present in the bath. Existing methods and apparatus for bath-composition control are marginally acceptable at best. This is especially true for the use of electroplating in semiconductor processing. Particularly problematic is the tendency for bath additives to fluctuate in concentration because their rates of consumption depend on factors and conditions that are not controlled or accounted for in the present art. There is a strong need to reduce such fluctuations and thereby to achieve highly stable process performance in manufacturing.

It is therefore an object of the invention to provide precise control of the constituents in a practical and automatic manner which requires little overhead.

It is another object of the invention to provide a chemical bath controlling system in which different modes of operation are utilized to determine the changes to be anticipated in the system.

It is a further object to provide a method for controlling the chemical characteristics of a bath which requires little human intervention by using predictive dosing.

These objects are accomplished by parsing the daily operating time periods of a chemical system into distinct operating modes in which depletion or increases in bath components may vary in a manner differently that in other modes.

Examples of distinct operating modes include standby, system active (without the process working on a workpiece) and active or working reaction mode.

These and other objects of the invention will become more apparent in view of the following more particular description of the invention and drawing.

BRIEF DESCRIPTION OF THE DRAWING

FIG. 1 is a schematic drawing showing a three cell electroplating system having independent control features in accordance with the invention.

DETAILED DESCRIPTION AND SPECIFICATION OF THE INVENTION

We describe a method and apparatus for controlling the chemical composition of a plating bath. The method is especially useful for achieving precise control of the concentrations of additives used in electroplating of high-value electronic parts.

The control system is based on predictor-corrector scheme of replenishment similar to that described in the above mentioned patent U.S. Pat. No. 5,352,350. Since frequent direct measurement of additive concentration may be time consuming and costly, it is advantageous to make the best possible use of predictive dosing, i.e., dosing prescribed by a dynamic model of the plating solution. Schemes for predictive replenishment of plating baths are known in the art. The effectiveness of the predictive component of the dosing system depends on how realistic and accurate the model is. The model used in the present invention accounts for a number of factors that are not accounted for in the prior art.

One such factor that is very important is time-based degradation of an additive species. Conventional bath-replenishment systems are chiefly based on the amount of plating charge passed (e.g., in Ampere-hours) or on the number of workpieces processed. We have found that a more accurate and versatile basis for replenishment is a linear combination of charge-based and time-based consumption. This basis is valid especially in systems involving an additive that is susceptible to homogeneous decomposition over time or to heterogeneous decomposition at, for example, the surface of an anode that remains in contact with the electrolyte when plating is not in progress. This is also particularly applicable when the bath volume is low, when the wetted anode area is high, or when the plating system is idle for significant periods, especially when such periods occur irregularly over time.

In the present invention, the dose $\Delta v_j$ of species j to be delivered on a predictive basis during a time interval of duration $\Delta$ is given by the expression:

$$\Delta v_j = k_j^t \cdot V \cdot \Delta t + k_j^q \cdot \Delta q$$

where V is the bath volume, $k^{tj}$ is an adjustable model parameter that describes the time-based consumption of species j, and $k_j^q$ is an adjustable model parameter that describes the charge-based depletion of species j.

An additional factor incorporated in the model of the present invention is the dependence of the depletion rate (especially the time-based depletion rate) on the number of plating cells through which the electrolyte is being actively pumped at a given time. This is implemented as follows:

$$k_j^t = k_j^{to} + n\Delta k_j^t$$

where n is the number of plating cells with active flow.

Another factor is the dependence of depletion rate on flowrate.

Yet another factor is the dependence of the additive depletion rate on the state of the anode. In particular we distinguish the period immediately following introduction of a fresh anode into the plating bath from the remainder of the anode's service lifetime, since the "breakin" period is characterized by the absence of a mature anode film. Accordingly, $$k_j^{tBREAKIN} > k_j^{tMATURE}$$

An additional dependency that we include to improve the accuracy of the model is on bath temperature. Generally, we adjust $k_j^t$ and $k_j^q$ upward at higher bath temperature. For example, $$k_j^t(T) = k_j^t(T_0) + b \cdot (T - T_0)$$

where b is a constant.

A variation of the invention is to base the rate of introduction of fresh bath on the actual consumption rate of one particular additive that is known to produce reaction product as it is consumed, i.e., during any given time interval t: $\Delta t$ $$\Delta v_{FRESH} = B \cdot \Delta v_{ADDITIVE}$$

where B is a constant.

The model keeps a running estimate of the concentration of each species in the plating bath, $C_j$. This estimate is decremented as depletion-causing events take place (such as plating, the passage of time, or dilution by another species) and incremented as concentration-elevating events take place (such as dosing, solvent evaporation, or generation by chemical or electrochemical reaction). The estimates are updated (i.e., "corrected") upon receipt of actual measurements from off-line or on-line analysis.

$$c_j \leftarrow C_j^{MEASURED}$$

The system decreases the risk of overdosing by requiring authorization before making abnormally large doses.

The material-balance model requires an accurate measurement of bath volume. Accuracy of this measurement is improved by providing an adjustment to the level-sensor reading for the number of system pumps that are running (since portions of the system become filled only when a pump is running).

Doses are injected into a fast-moving stream of electrolyte, so that mixing delays are minimized.

Dosing

General Discussion on Smart Dosing

A novel feature of bath maintenance is the ability to predict concentration changes in the three additive species (A, B, C), based on the assumption that a given additive may degrade linearly due to the passage of time and charge. The predictive algorithm compares the predicted concentration of a species to its target concentration at five minute intervals and calculates an ongoing quantity ("REQdose") of additive from the dosing reservoir that would be required to reset the bath to its target concentration for that additive. If the predicted additive concentration is greater than the target, then "REQdose" will be tracked as a negative quantity, implying no dosing response is necessary. However, if the additive concentration is below the target concentration, "REQdose" will be a positive quantity, and if it exceeds the minimum allowable dose (MIAD, see Table 1), then the metering pump for that additive species is activated and the required dose is administered to the central bath reservoir. The volume of additive ("REQdose") is also an input to the dosing algorithm and it is used to recalculate the predicted concentration of additive at time, n, by:

$$C_n^i = C_{n-1}^i + ((ml_n^i)/(l_n^B))$$

where: $C_n^i$=The predicted concentration of additive, i, at nth time interval, in ml/liter.

$C_{n-1}^i$=The predicted concentration of additive, i, at time, n−1 (previous calculated concentration), in ml/liter.

$ml_n^i$=The number of ml of additive, i, dosed at time, n $l_n^B$=The number of liters of central plating bath ("B") at time, n.

In this scheme, the delivered dose, $ml_n^i$, should be equal to "REQdose", a continuously updated volume, maintained at all times by the smart dosing program, and recorded in the dosing data log. The value, $l_n^B$, is input based on a reading at time, n, from an analog liquid level sensor that reads the height of the plating bath liquid column and multiplying is by the surface area of the reservoir to give the actual bath volume at that time An additional feature provided is the definition of a maximum allowable dose ("MAAD", see Table 1). If "REQ-dose" for a given additive exceeds its maximum allowable, no dose will be administered and a system alarm is triggered. Currently, the tool continues to run despite the dosing inhibit. The alarm should initiate further investigation as to the actual bath status to the operator and/or engineering.

TABLE 1

| Dosing constraints max/min | | |
|---|---|---|
| Additive | MIAD | MAAD |
| A | 5 ml | 150 ml |
| B | 5 ml | 200 ml |
| C | 5 ml | 50 ml |
| "FB" | 500 ml | 20 liters |

KEY:
MIAD = Minimum Allowable Dose
MAAD = Maximum Allowable Dose
FB = Fresh (Bulk plating solution) Bath Linear Degradation Model At the center of smart dosing is a model which assumes that the additive degrades linearly in time, with charge, or both. The model is defined by empirically derived coefficients, each of which is proportional to the concentration degradation rate of the given species. In addition, a 'percentage' correction for dimensional conversion is also included, as is appropriate for calculation of the requisite concentration change. Table 2 summarizes the model degradation coefficients and the 'percentage' correction factor for additives A, B, C, and FB (fresh plating bath).

TABLE 2

| Dosing coefficients | | | |
|---|---|---|---|
| Item | Time Based (ml/liter/hour) | Charge Based (ml/liter/A-hr) | Percentage |
| FB | 4.167 | 0 | 100 |
| DI (water) | 0 | 0 | 100 |
| A | 0.02 | 0 | 28 |
| B | 0.128 | 0.5 | 100 |
| C | 0.004 | 0.15 | 100 |

Note: These coefficients reflect the values during an isolated evaluation and must be empirically estimated for particular use conditions.

Note that both the fresh plating bath (FB) and deionized water (DI) are treated by the smart dosing model as additives and may be treated, for calculation purposes, as a 'concentration.' For example, FB degrades, additive wise, in the sense that the plating bath itself must be drained by an amount equivalent to replacing 10% of the bath volume per 24 hours of production, and replaced by an equivalent volume of fresh bath, or FB. During the initial testing, the dosing algorithm did not automatically compensate for water loss due to evaporation; hence, the coefficients were set equal to zero as shown in Table 2. Thus, the indicated degradation coefficient for FB should meet the needs of 10% exchange per day to maintain steady state in the central bath reservoir for all chemical species:

$$FB \text{ Degradation Coefficient} = \left(\frac{ExchangedVol - \text{ml}}{BathVol - \text{liters}}\right) \Big/ 24 \text{ hours}$$

$$= \left(\frac{15{,}000 \text{ ml}}{150 \text{ liters}}\right) \Big/ 24$$

$$= 4.167 \text{ ml/l/hr}$$

Approximate Performance

An attempt was made to track the ability of autodosing via the 'smart dosing' algorithm for the case of one of the additives. The chosen species was B. No attempt was made to assess this comprehensively due to the number of competing activities, starts, stops, software fixes, etc. associated with the test.

The B concentration was observed to drop by about a third over the course of 24 hours . This change did not appear to be reflected by the algorithm and suggests that the degradation constant needed to be increased. Based on this, the coefficient was increased to the value listed in Table 2. Further evaluation of smart dosing was inhibited by other test issues. Examination of the datalog showed that the algorithm functioned as required for B.

Smart Dosing and SPC

The smart dosing algorithm theoretically operates in an adjunct manner with SPC control of bath additives. When correctly configured, it will account for all time and charge based additive degradation, all concentration changes due to volume exchange, all evaporative losses, and all occurrences of manual dosing. It will attempt to control the additives to their target concentration and will trigger an alarm if the maximum allowable dose for a given additive is exceeded by a manual or auto-generated (algorithmic) requests. As a final fail safe, any series of manual doses that result in a predicted additive concentration in excess of a predetermined control limit will inhibit the further introduction of new wafers to any plating cell.

Correction of the predicted data via external measurement will be configured so that operators may make the input at any time, thereby resetting the predicted value to a known (actual) value. This measured value is a direct measure of bath quality that is also part of normal SPC control. In effect, SPC control procedure will help to drive the smart dosing coefficients to their optimized values. This will not only produce more stable plating baths, but also reduce the frequency of measurements.

Specific Example of the Preferred Embodiment

The central feature that controls all of the chemistry of the electroplating system of the preferred embodiment is the dosing system.

Dosing System Operation

The central feature that controls all chemistry in the tool is the dosing system. It consists of a large central bath from which a small percentage continually circulates through the plating cells in which wafers are being processed. The chemistry of the bath is controlled through sophisticated algorithms in the dosing software that control the timely addition of the main components of the bath (plating solution and DI water) and the 3 additives in order to maintain the bath chemistry over time.

The main reasons for adding fresh plating solution is to dilute the effects of the byproducts of the plating process. During the plating process the organic additives break down into other components and, therefore, lose their effectiveness. While fresh additives are being added to maintain the process, the break down products would eventually contaminate the bath to the point that the plating process would degrade. By adding sufficient fresh plating solution based on the usage of the system, the breakdown products will reach a limiting concentration at a level where they will not degrade the process.

DI water is added to offset evaporation. In a typical fab set up evaporation rates of about 6 to 8 liters per day have been measured. Although some DI water is added to the bath unintentionally during the rinse step in the plating cells, this will not be enough to off-set the evaporation unless the system is very highly utilized. Thus the dosing algorithms are designed to offset the evaporation while taking the rinse steps into account.

The additives in the bath degrade over time because of both their instability and their consumption during the plating process. The dosing algorithms are designed to track this degradation and add fresh additives to the bath to keep the additives at their respective target concentrations.

Hardware Description

The layout of the dosing system is schematically shown in FIG. 1. All components are laid out around the central bath and plating solution is taken from the bath and circulated through the three plating cells, while fresh components are being added.

Central Bath, Re-circulation Pumps, Circulation through Anode Cells, Sample Port The central bath is a large tank 10 that will typically contain about 150 liters of the plating solution. A Re-circulation pump 12 maintains a constant flow to ensure proper mixing of the plating solution both with respect to chemical composition and to temperature. In the recirculation loop a small sample port 14 is present where samples of the plating solution can be taken for off-line analysis.

Three pumps 16, 18, and 20 circulate plating solution from the central bath through each of the plating cells. After flowing through the cells, the plating solution is returned to the central bath. This ensures that the composition of the plating solution in each of the plating cells is at all times identical to the composition of the plating solution in the central bath.

The level of plating solution in the bath is measured through an ultra-sonic level sensor, allowing the volume of the plating solution to be calculated. The level of the solution in the bath is converted into a volume and for each plating solution pump running an additional volume is added to include the amount of plating solution in the lines, filter, and anode cell. This additional amount per plating cell can be changed through the User Interface. The default value is 7 liter, which applies to a 200 mm tool.

Dosing System Hardware

Typically, the dosing system will add 5 different source materials to the central bath based on the dosing algorithms. These 5 chemicals are delivered to the bath by 5 delivery systems with completely independent plumbing. Because the quantities of fresh plating solution 22 and DI water 24 (between 4 and 15 liters per day) are substantially larger than the quantities of additives A, B, and C (between 0.005 and 0.5 liters per day), they are handled by different delivery systems.

Plating Solution and DI Water Supply

The hardware to control the addition of fresh plating solution and DI water is very simple. In the supply lines there are pneumatic valves 26FB and 26DI and a flow gauges 28FB and 28DI, called a totalizers Fresh plating solution and DI water are delivered to the system pressurized. Their flow into the bath goes through totalizers. Totalizers 28 are flow gauges that track the amount of liquid being delivered. They contain short tubes in which a small propeller is mounted. The flow of the liquid forces the propeller to spin and this movement is detected through electromagnetic inductive coupling. So when the dosing algorithms conclude that a certain amount of liquid has to be delivered, the pneumatic valve is opened and the totalizer electronics integrates the amount of liquid flowing through the flow gauge until the desired volume has been reached. At that point the pneumatic valve is closed and the bath composition is adjusted by the dosing software for the amount of liquid that has been delivered.

Additive Supply

The additives are delivered to the central bath through a slightly more complex delivery system. As shown in FIG. 1, each delivery system consists of a pneumatic valve 30, a gear pump 32 with closed loop speed control and a flow switch 34. During setup of the tool, and later during certain preventative maintenance routines, the pumps are calibrated and the flow rate is entered into the dosing system software. When the dosing algorithms indicate that a certain amount of an additive needs to be added to the bath, the software will give simultaneously an open command to the valve and a start command to the pump. Based on the required volume and the known flow rate of the pump a required flow time is calculated. When this time expires the pneumatic valve is closed and the pump stopped.

Flow switches 34 are used to verify that additive is actually being delivered when needed. This verifies operation of the pneumatic valve and the dosing pump. However the flow switch is a digital switch and can not determine small variations in the actual flow. The flow switch is also used to verify that the flow actually stops after the stop/close command has been issued. This protects the system from large amount of additives being added to the central bath through failure of the pump, the pneumatic valve, or the control software and hardware.

An additional protection is built into the additive supply hardware in the form of a master relay. This relay will disconnect the 24V power to the additive pumps in case one of many sensors is activated. These sensors include the leak sensors, the exhaust sensor, skin sensors, and some facility related sensors.

Additive Source Bottles

While the fresh plating solution and DI water are supplied to the tool through bulk delivery lines, the additives are contained in bottles 36 inside the tool. These bottles will have to be filled by the customer whenever the low level sensor is being tripped. Depending on the use of the system bottles might have to be filled as frequently as once every 3 days. Certain safety precautions have to be taken while the bottles are removed from the tool and filled.

Drain

Since the dosing algorithms continuously add liquids to the bath and since, except for some evaporation, no liquid is removed from the bath during processing, the volume of the central bath is limited by occasionally draining part of the plating solution. The drain function is completely separate from the dosing system. The default values for a 200 mm tool are that drain 38 will open when the volume of plating solution in the bath reaches 156 liter and the drain will close again when the volume is reduced to 140 liter. These settings can be adjusted by the user though the User Interface except that the upper limit can not be set any higher than the 156 liter default value.

If the upper limit level is reached while any chemicals are being delivered to the central bath (most likely while fresh plating solution or DI water is being delivered), the incoming flow is immediately stopped. An informative warning that this happened will be shown in the event logs. Although the amount delivered in this situation is not identical to the amount requested, the dosing software tracks the actual amount delivered and all volumes and concentrations will be adjusted accordingly.

Note: Draining the bath has no effect on the composition of the bath since the plating solution is assumed to be perfectly mixed. Therefore no changes are needed for additive concentration or the dosing algorithms other than that the bath volume changes.

Temperature Control

The temperature of the plating solution is maintained through a heater/chiller that circulates temperature controlled water through a radiator in the bath. A RTD (Remote Temperature Device) that is positioned in the bath allows for closed loop control. Typical operating temperatures are between 20 and 25° C. Although this operating temperature is above room temperature, the bath actually has to be cooled to reach this temperature. The heat dissipating from the four pumps next to the bath would heat up the bath to about 28° C. if the heater/chiller was turned off.

Dosing Algorithms

The following paragraphs describe the theory on which the dosing system software is based and the algorithms used in the calculations. It will end with a series of examples to show how these algorithms result in sources being added to the bath on a 24 hour basis.

Theory

The bath consists predominately of plating solution and DI water, in a typical 150 liter bath, all additives combined add up to about 4 liters or less than 3% of the total bath. Because of this the two main components are tracked differently from the additives.

Volume Based Calculations

Both plating solution and DI water are tracked by the dosing software in absolute volume present in the bath. Additions are made to the bath in absolute volume. The amount of plating solution or DI water added to the bath on a daily basis is thus not dependent on whether the bath is at 156 (maximum) liters or at 140 (minimum) liters, although the parameters for the dosing algorithms are based on a 150 liter bath.

Concentration Based Calculations

The additives in the bath are tracked by their concentration. Whenever a quantity of any of the additives is added to the bath, this quantity is immediately converted in a concentration change based on the actual bath volume at that time.

Dosing Parameters

There are two sets of parameters that control the dosing system. The first set contains the target concentrations for the additives. The second set contains the constants for the dosing algorithms.

The target concentrations are set on the User Interface in the dosing system. Typical target concentrations are:

| | Value | Unit |
|---|---|---|
| Chem A | 55 | mg/l |
| Chem B | 8 | ml/l |
| Chem C | 3 | ml/l |

Note: These target concentrations can be changed by the user as needed.

The algorithms used to control the bath chemistry are defined by the dosing parameter table. The values in this table can be changed by the user based on experience with the operation of his tool. At installation, the dosing parameter table will look roughly as follows:

| | Baseline degradation | | Per pump degradation | | Consumption | |
|---|---|---|---|---|---|---|
| | Value | Units | Value | Units | Value | Units |
| Fresh bath | 26 | ml/hr | 104 | ml/hr | 20 | ml/A-hr |
| DI water | 83 | ml/hr | 83 | ml/hr | −5 | ml/wafer |
| Chem A | 0.002 | mg/l | 0.000 | mg/l | 0.40 | mg/A-hr |
| Chem B | 0.005 | ml/l | 0.020 | ml/l | 0.50 | ml/A-hr |
| Chem C | 0.001 | ml/l | 0.001 | ml/l | 0.15 | ml/A-hr |

Under normal circumstances the bath composition is adjusted for the effects of degradation every five minutes, while the effects of consumption arc calculated every time a wafer is finished plating. Whenever for some reason the power is off, the dosing software is obviously not able to track the bath composition. If within four hours the power is restored, the dosing software will estimate the bath composition based on the elapsed time and the bath composition will be brought back to specification. If, however, power is not restored within four hours, the system will set all additive concentrations to zero since it is assumed that it is not possible to track the bath composition accurately over such a long time when no additions are being made. If this happens the user should do a bath analysis before using the system for further processing.

Each of the three types of algorithm parameters (baseline degradation, per pump degradation, and consumption) will be discussed separately.

Baseline Degradation

The baseline degradation constants describe the changes in the bath when the system is completely inactive. This operating mode is referred to as the inactive or idle mode. Even when the system is completely idle, the additives will slowly degrade and water will evaporate. To offset the buildup of breakdown products of the additives, fresh plating solution is supplied.

Per Pump Degradation

When the plating solution pumps are turned on, the exposure of the plating solution to air and to the copper anodes is greatly increased. This operating mode is referred to as the active, no workpiece mode. Thus the degradation of the additives is increased substantially for each pump that is turned on. And increased degradation results in an increase in build up of breakdown products. Thus the amount of fresh plating solution added to the bath is also increased for each pump turned on.

Note: Empirical observations indicate that per pump degradation is a function of the plating solution flow rate. Currently, the per pump degradation constants and the degradation algorithm do not reflect this factor. The constants in the default table are those for plating solution flow rates of 8 liters per minute. Enhancements of the software can incorporate the flow rate into the degradation algorithm. Until that time it is necessary for the user to make this adjustment manually if and when the plating solution flow rate is changed.

Consumption

The operating mode when wafers are actually being plated is referred to as the consumption or active mode. The consumption algorithm is executed every time the dosing software is notified that a workpiece or wafer has finished plating. A certain amount of consumption of additives occurs whenever a wafer is plated. The amount of consumption is directly proportional to the amount of power consumed while plating the wafer (Faraday's Law). The consumption constants thus specify the change in concentration of an additive per amp-hour of power consumed. Just as in the degradation algorithms, fresh plating solution is added at a rate set to offset the creation of breakdown products of the additives.

In addition, the plating of a wafer results in a 'negative consumption' of DI water, as the rinse cycle in the plating cell adds a known amount of water to the bath.

Bringing Additives up to Target after Adding Fresh Bath

Whenever fresh plating solution is added to the bath through the dosing system (either manually or driven by the dosing algorithms), the dosing software will track the volume change and the changes in the concentrations of the additives. Based on the changes in the concentrations it will then bring the bath back into specification by adding additives.

Note: If only a small amount of fresh plating solution is added, the addition of additives might be postponed because the needed quantities are too small, as explained below.

Examples of Everyday Calculations

Below, three examples are worked out of the actual effects of the dosing algorithms including the effects on the additives of adding fresh plating solution. This should clarify these complex algorithms. All these calculations are based on a 24 hour period. In all these calculations the assumption is made that the of the bath is 150 liters. In reality, the calculated values will vary based on the actual bath volume, which is measured before each calculation.

| Baseline Degradation Only (no pumps running, no wafers processing) | | |
|---|---|---|
| fresh bath added per day | 26 ml/hr × 24 hrs = | 624 ml |
| DI added per day | 83 ml/hr × 24 hrs = | 1992 ml |
| Chem A added per day | | |
| because of degradation | 0.002 mg/l/hr × 150 l × 24 hrs = | 7.2 mg |
| because of fresh bath | 55 mg/l × 0.624 l = | 34.3 mg |
| total | | 41.5 mg |
| convert mg to ml | 41.5 mg/3.646 mg/ml = | 11.4 ml |
| Chem B added per day | | |
| because of degradation | 0.005 ml/l/hr × 150 l × 24 hrs = | 18.0 ml |
| because of fresh bath | 5 ml/l × 0.624 l = | 3.1 ml |
| total | | 21.1 ml |
| Chem C added per day | | |
| because of degradation | 0.001 ml/l/hr × 150 l × 24 hrs = | 3.6 ml |
| because of fresh bath | 3 ml/l × 0.624 l = | 1.9 ml |
| total | | 5.5 ml |

| Degradation With All Three Pumps Running (no wafers processing) | | |
|---|---|---|
| Fresh Bath added per day | (26 + (3 × 104)) ml/hr × 24 hrs = | 8112 ml |
| DI added per day | (83 + (3 × 83)) ml/hr × 24 hrs = | 7968 ml |
| Chem A added per day | | |
| because of degradation | (0.002 + (3× 0)) mg/l/hr × 150. l × 24 hrs = | 7.2 mg |
| because of fresh bath | 55 mg/l × 8.112 l = | 446.2 mg |
| total | | 453.4 mg |
| convert mg to ml | 453.4 mg/3.646 mg/ml = | 124.4 ml |

-continued

| Degradation With All Three Pumps Running (no wafers processing) | | |
|---|---|---|
| Chem B added per day | | |
| because of degradation | (0.005 + (3 × 0.020)) ml/l/hr × 150 l × 24 hrs = | 234.0 ml |
| because of fresh bath | 8 ml/l × 8.112 l = | 64.9 ml |
| total | | 298.9 ml |
| Chem C added per day | | |
| because of degradation | (0.001 + (3 × 0.001)) ml/l/hr × 150 l × 24 hrs = | 14.4 ml |
| because of fresh bath | 3 ml/l × 8.112 l = | 24.3 ml |
| total | | 38.7 ml |

| Running 100 wafers per day using the 7 Amp, 134 second plating process 100 wafers at 7A for 134 sec = 700A × 134 sec/3600sec/hr = 26 A-hr | | |
|---|---|---|
| Fresh Bath added per day | | |
| added based on time | (26 + (3 × 104)) ml/hr × 24 hrs = | 8112 ml |
| added based on plating | 26 A-hr × 20 ml/A-hr = | 520 ml |
| total | | 8632 ml |
| DI added per day | | |
| added based on time | (166 + (3 × 0)) ml/hr × 24 hrs = | 3984 ml |
| not added based on plating | 100 wafers x − 5 ml/wafer = | −500 ml |
| total | | 3484 ml |
| Chem A added per day | | |
| because of degradation | (0.002 +3 × 0) mg/l/hr × 150 l × 24 hrs = | 7.2 mg |
| because of fresh bath | 55 mg/l × 8.632 l | 474.8 mg |
| because of plating | 26 A-hr × 0.4 mg/A-hr = | 10.4 mg |
| total | | 492.4 mg |
| convert mg to ml | 492.4 mg/3.646 mg/ml = | 135.0 ml |
| Chem B added per day | | |
| because of degradation | (0.005 + (3 × 0.020)) ml/hr × 150 l × 24 hrs = | 234 ml |
| because of fresh bath | 8 ml/l × 8.632 l = | 69 ml |
| because of plating | 26 A-hr × 0.5 ml/A-hr = | 13 ml |
| total | | 316 ml |
| Chem C added per day | | |
| because of degradation | (0.001 + (3 × 0.001)) ml/l/hr × 150 l × 24 hrs = | 14.4 ml |
| because of fresh bath | 3 ml/l × 8.632 l = | 25.9 ml |
| because of plating | 26 A-hr × 0.15 ml/A-hr = | 3.9 ml |
| total | | 44.2 ml |

Minimum and Maximum Amounts Delivered Through the Dosing System

Neither pumps nor totalizers can accurately deliver liquids in very small quantities. Therefor minimum dose quantities have been programmed in the dosing software. Any time a calculation of the dosing algorithms results in a requested dose less than the minimum dose, the dose is not delivered. The dosing software will track the changes in the bath composition until the dose necessary to bring the bath back to target reaches the minimum dose. The minimum dose for each of the totalizers is 0.5 liter. The minimum dose for the additives is 50 ml for Chem A, 30 ml for Chem B, and 10 ml for Chem C.

Maximum doses have also been programmed in the software for the totalizers. This prevents addition to the bath of very large unintended doses that would bring the bath composition so far out of specification that the only recovery method would require draining large amount of plating solution. The maximum dose for the totalizers is 10 liters.

The amount of additives that will be added to the bath automatically is also limited. This feature in described below in the section about manual additions to the bath of additives.

Adjustments After a Bath Analysis

Any time the bath has been analyzed the current concentrations in the bath composition can be adjusted through the User Interface. If the adjustments are relatively small, the dosing system will accept the new concentrations. If the new concentrations are below target, additives will be added to the bath to bring it back to target. If the new concentrations are above target, no new additives will be added to the bath until the concentrations drop below target again through a combination of degradation and consumption.

If the entered concentrations are between the warning limits and the fault limits, then the system will accept the entered number. Once the number is entered the bath obviously is outside the warning limit, so a warning will be posted. This warning does not prevent the user from processing wafers. If the entered concentration is low then the dosing system will add whatever amount of additive is needed to bring the bath back to target. If the entered concentration is high, then no additive will be added to the bath until the concentration has dropped back to target through a combination of degradation and consumption.

If the entered concentrations are outside the fault limits, then again the dosing software will ask for a confirmation before accepting the new concentrations. If the user confirms these new concentrations the dosing software will accept the new concentrations and immediately generate an alarm that the bath is outside the fault limits. No other actions are taken. If the user would attempt to start a run, the bath would go into error state and the run would not start. If the concentrations are too high the user has the option of diluting the bath with fresh plating solution or waiting for the degradation to take its course. If the concentrations are too low, the dosing system will not bring them up to target automatically. The user will have to do this manually at least to the point that the concentrations are back within the fault limits.

Note: If the bath analysis routinely results in measured concentrations outside the warning (or worse the fault) limits, then user should verify that the warning and fault limits arc set appropriately. If that is the case the user should consider adjusting the parameters used in the dosing algorithms.

Manual Additions

For any of the five sources it is possible for the user to make manual additions to the bath through the User Interface. For each source the user can give a command to add, within limits described below, a certain volume to the bath. The most common situation for this to happen will be after a bath analysis that results in additive concentrations outside the fault limits. A bath analysis can also result in a bath that is too concentrated or diluted with respect to the amount of Copper or Acid. In this situation the user has the capability to add either fresh plating solution or DI water to the bath.

Before the dosing software will execute a manual dose, it will model the outcome first. It will calculate the concentration of the requested additive after the dose is completed. If the new concentration would be outside the fault limits then the system will post an alarm and not execute the command. If the new concentration would be between the warning and the fault limits then the software will execute the command and a warning will be posted that the bath concentration is now outside the warning limits. This will not prevent the user from starting a process.

Software Checks/Verification

There are many checks built into the software to verify as much as possible that the system runs as expected. In the previous section several of these checks with respect to manual dosing and bath concentration out of spec have been described above. Several more are described here.

Plating Solution and DI Water Supply Checks

The following checks take place when either fresh plating solution or DI water if being delivered to the bath.

Communications Time-out

If the software sends a message to a totalizer and does not receive a reply within a specified period of time (approximately 10 seconds), an alarm is generated. If wafers are being processed, the wafers currently processing in the tool are processed and placed back into their cassettes and no new wafers are scheduled. The tool stops scheduling new wafers until it once again successfully communicates with the totalizer.

Dose Request Time-out

If a dose request is not completed within a specified period of time, an alarm is generated. The default time-out interval is based on a flow rate of 300 msec/ml. The time-out interval can be changed via the User Interface bath module Info screen and typically provides a 100% safety margin for a nominal deliver rate of 400 ml/min. A dose request time-out usually occurs because the facility's supply of either fresh plating solution or DI water has run dry. If wafers are being processed, the wafers currently processing in the tool are processed and placed back into their cassettes and no new wafers are scheduled. The tool stops scheduling new wafers until it once again successfully completes a requested dose.

Required Dose Exceeds Allowable Maximum

If a scheduled dose exceeds the maximum dose allowed (10 liter), then an alarm is generated and the dose is not delivered. If wafers are being processed, the wafers currently processing in the tool are processed and placed back into their cassettes and no new wafers are scheduled.

There are two ways to clear this condition, and they must both be performed manually with bath module off-line:

1. set the deficit to a value less than 10,000 ml.
2. perform one or more manual doses until the deficit is less than 10,000 ml.

Additive Supply Checks

These are some of the checks in the software with respect to the additive supply.

Flow Not Detected

The software checks the state of the flow detection sensor approximately one second after the dose is started. If the sensor has not detected flow, then the requested dose is terminated, and a warning is generated. The software assumes that no liquid was delivered, and the concentration of the associated chemical additive is not changed.

Unexpected Flow Detected

If a flow detection sensor activates when a dose for the associated chemical is not in progress, then:

an alarm is generated the dosing pump master enable switch (which controls power to all additive pumps) is turned off (which also generates an alarm)

Additive Bottle Levels Low

When the low level sensor in one of the additive bottles detects that the bottle is almost empty, then it will post a warning. If wafers are being processed, the wafers currently processing in the tool are processed and placed back into their cassettes and no new wafers are scheduled. After the bottle has been filled, the user will have to perform error recovery before starting to process wafers.

Bath Not Draining

During a bath drain operation, the software will verify that the command is executed within a specified period of time. This time is based on a time limit set in the software. This limit can be changed through the User Interface. If during a bath drain operation the lower volume limit is not reached, then the system will generate a warning, bit no further action is taken.

Temperature Out of Specification

The temperature of the bath is continuously monitored by the heater/chiller. As part of the bath Get Ready Program the temperature set point and the error limits are set. Typical error limits are 5% which is about 1° C. If the temperature goes outside the error limits an alarm will be generated whether the tool is processing wafers or not. If wafers are being processed at the time of the alarm, the wafers currently processing in the tool are processed and placed back into their cassettes and no new wafers are scheduled.

Bath Chemistry out of Specification

The most common way for the bath chemistry to get out of specification is because of actual concentration value entered by the user after a bath analysis. However it is possible that through failure of an additive supply the bath will be out of specification although many warnings should have been posted by the software long before that happens.

If the user attempts to start a run with the bath chemistry out of specification, the bath will go into error and the run will not start. If the bath would go out of specification while wafers are being processed, then the wafers currently processing in the tool are processed and placed back into their cassettes and no new wafers are scheduled.

Dosing Logs

All calculations performed by the dosing algorithms and all actions taken with respect to additions and bath draining are stored in the dosing logs. These logs are massive and can grow as fast as 30 pages per hour for a fully running system.

On top of the current dosing log, the system will keep the last 100 logs in a sub-directory. These logs are number 00 through 99 and once 99 is reached, the system will start again at 00 and will start over-writing the oldest files. These 100 files should cover at least the last 30 days even for a system running at full capacity.

While the invention has been described in terms of the preferred embodiment, those skilled in the art will recognize that variations might easily be made to render the system useful in other applications such as a process having four distinct operating states in stead of the three described herein. These and other changes are clearly intended to be included in the invention.

What is claimed is:

1. A method for controlling the concentration of a plurality of chemical species in a wet chemical bath of predetermined composition for a processing tool including a bulk tank, a plurality of workstations coupled to the bulk tank and a plurality of sources of additives, comprising the steps of:

characterizing the status of the tool into said plurality of operational modes;

determining a material balance for each of a plurality of chemical species under each operational mode, determining a minimum dose of additive for each said chemical species comprising the components of the bath;

determining the rate at which each additive to the bath will be depleted or generated within each of said operational modes;

determining when the value of each additive exceeds said minimum dose; and adding said minimum dose or greater of respective additives determined to have exceeded said minimum dose to said bath.

2. The method of claim 1 wherein said operational modes include at least one inactive or standby mode and one active mode.

3. The method of claim 1 wherein said chemical bath is an electroplating bath.

4. The method of claim 3 wherein said operational modes comprise a baseline or idle mode, an active, no workpiece, mode and an active mode.

5. The method of claim 4 wherein the step of adding said minimum dose to said bath occurs at least after the completion of the plating of each workpiece.

6. The method of claim 4 wherein the basis for calculating required doses is based on elapsed time for said baseline and active, no workpiece, modes.

7. The method of claim 1 wherein said material balance includes external effects including environmental effects.

8. The method of claim 7 wherein external effects include evaporation of aqueous additives.

9. The method of claim 1 further including the step of periodically measuring the concentration of at least one additive to determine that the effects of adding said minimum or greater dose has not significantly altered said predetermined composition of said bath.

10. The method of claim 3 wherein said minimum determined dose is a function of the number of plating electrodes present in the processing tool.

11. The method of claim 10 wherein said minimum dose is a function of the current drawn by each plating electrode.

* * * * *